US007468022B1

(12) United States Patent
Liang

(10) Patent No.: US 7,468,022 B1
(45) Date of Patent: Dec. 23, 2008

(54) BIDIRECTIONAL SINGLE LINKAGE DAMPING MECHANISM FOR LEG EXERCISER

(75) Inventor: Hung-Min Liang, Taichung Hsien (TW)

(73) Assignee: Hexon Enterprise Co., Ltd., Taichung County (TW)

( * ) Notice: Subject to any disclaimer, the term of this patent is extended or adjusted under 35 U.S.C. 154(b) by 0 days.

(21) Appl. No.: 12/051,071

(22) Filed: Mar. 19, 2008

(51) Int. Cl.
*A63B 22/00* (2006.01)
*A63B 22/04* (2006.01)

(52) U.S. Cl. ..... 482/52; 482/63; 482/51

(58) Field of Classification Search ..... 482/51–53, 482/57, 70, 63, 110
See application file for complete search history.

(56) References Cited

U.S. PATENT DOCUMENTS 3,603,121 A * 9/1971 Burkland ..... 68/23.4
4,574,649 A * 3/1986 Seol ..... 74/138
5,135,447 A * 8/1992 Robards et al. ..... 482/52
5,238,462 A * 8/1993 Cinke et al. ..... 482/52
6,824,505 B1 * 11/2004 Chang ..... 482/95
7,086,991 B2 * 8/2006 Williams et al. ..... 482/37
7,276,018 B2 * 10/2007 Studdard ..... 482/142
2003/0060343 A1 * 3/2003 Sechrest et al. ..... 482/94

* cited by examiner

*Primary Examiner*—Steve R Crow
(74) *Attorney, Agent, or Firm*—Egbert Law Offices PLLC

(57) ABSTRACT

The present invention provides a bidirectional linkage single damping mechanism suitable for a leg exerciser. The invention includes a circular drive element, which shifts circularly to define a first section and a second section in opposite motion directions. A brake swinging arm, provided with a coupling end and a swinging end. The coupling end is connected with a treading rotation axis; and the swinging end is connected with either section. The two sections drive separately two drive pulleys. A bidirectional drive pulley assembly has two rotary pulleys and two drive pulleys connected by a unidirectional bearing. The bidirectional drive pulley assembly then drives a damping wheel assembly. With this invention, it is possible to provide a damping mechanism that can be connected with the leg exercisers for an improved resistance.

6 Claims, 9 Drawing Sheets

BIDIRECTIONAL SINGLE LINKAGE DAMPING MECHANISM FOR LEG EXERCISER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a damping mechanism, and more particularly to an innovative damping mechanism with a bidirectional linkage single damping mechanism suitable for a leg exerciser.

2. Description of Related Art Including Information Disclosed Under 37 CFR 1.97 and 37 CFR 1.98

The leg exerciser of the present invention refers to sports equipment for treading and bidirectional swinging.

Leg exercisers are generally formed in such a manner that left and right pedal supports are provided with a pneumatic rod to generate a damping effect during a treading action. Moreover, some fitness equipment is fitted with an additional damping adjustment mechanism, resulting in a complex and cumbersome structure. The leg exercise equipment is comparatively compact; the actual application is limited to this smaller space even if it is equipped with a pneumatic rod and damping adjustment mechanism. Furthermore, the pneumatic rod is expensive and lacks a flexible damping effect, so the damping performance of a leg exercisers could not be further improved.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The present invention provides a damping mechanism that can be connected to a leg exercisers. The damping mechanism includes a bidirectional linkage single damping mechanism, providing desired resistance for the treading action of leg exerciser. Moreover, the resisting performance of the damping mechanism with a pure damping function can be improved greatly to meet the customer demands.

The damping mechanism can be connected to different leg exercisers, so that an original damping mechanism and adjustment mechanism for leg exercisers could be saved to reduce the costs and to improve the economic benefit.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
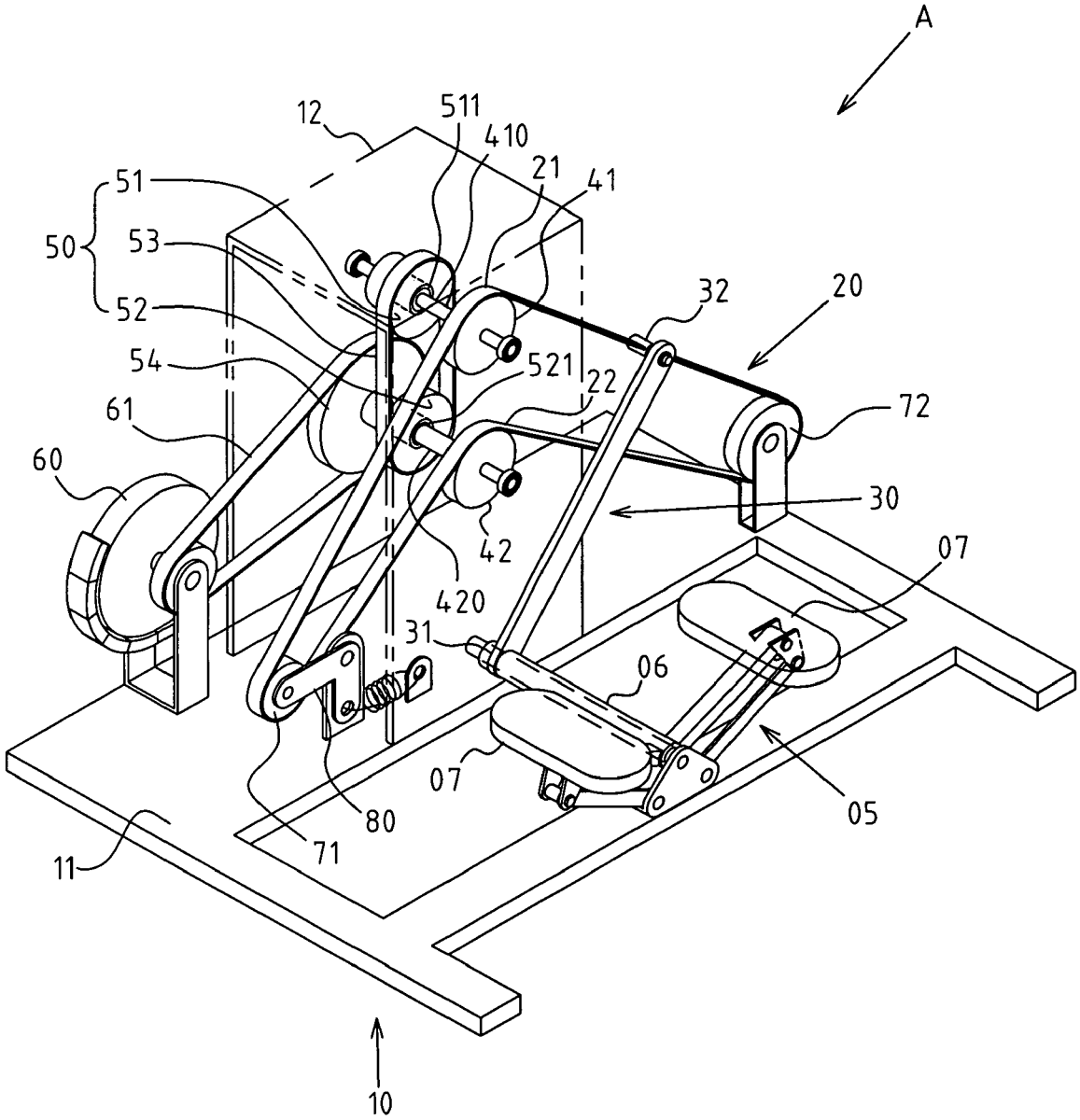
FIG. 1 shows an assembled perspective view of the preferred embodiment of the present invention.
Figure 2:
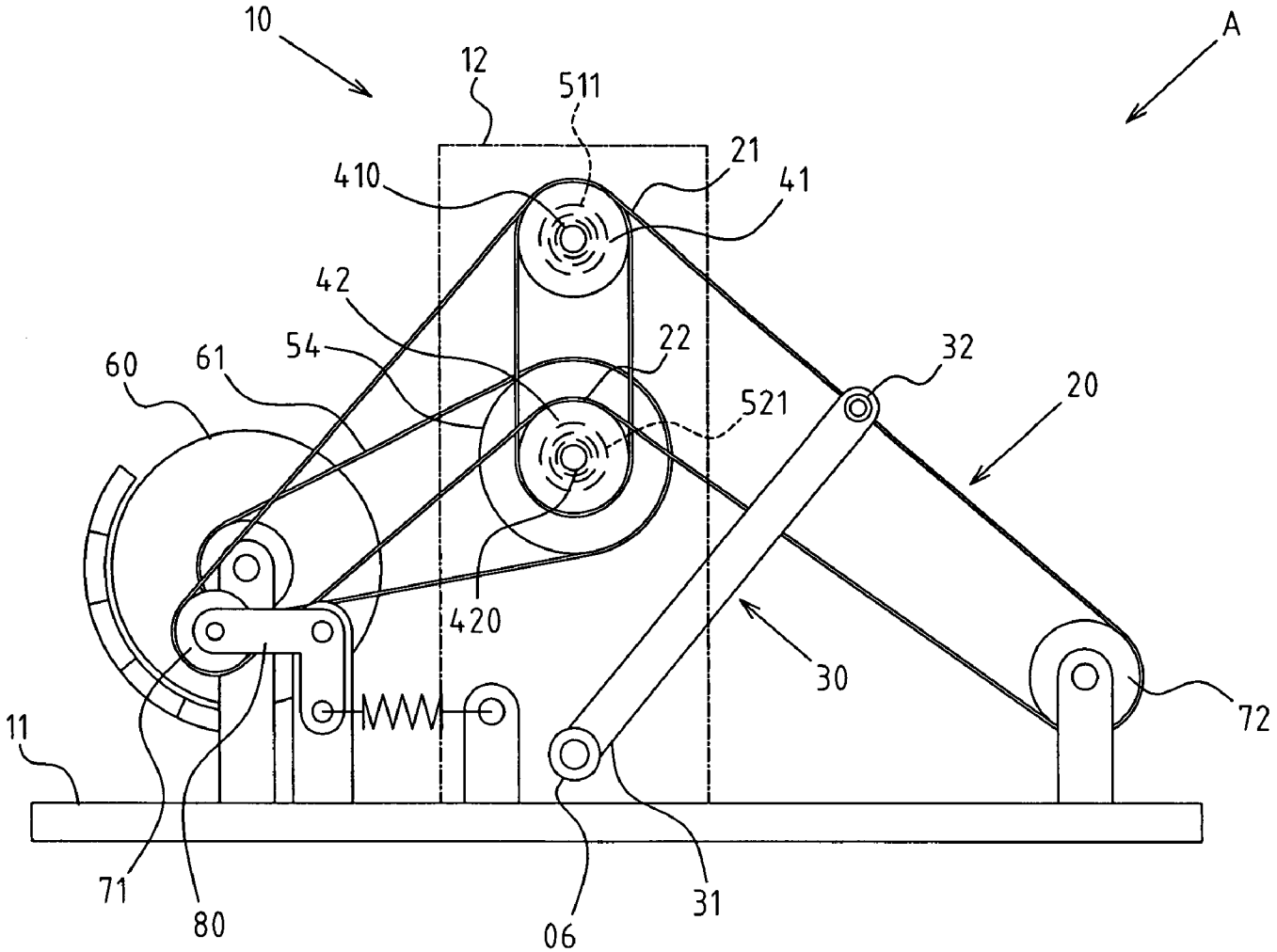
FIG. 2 shows a side elevation view of the preferred embodiment of the present invention.
Figure 3:
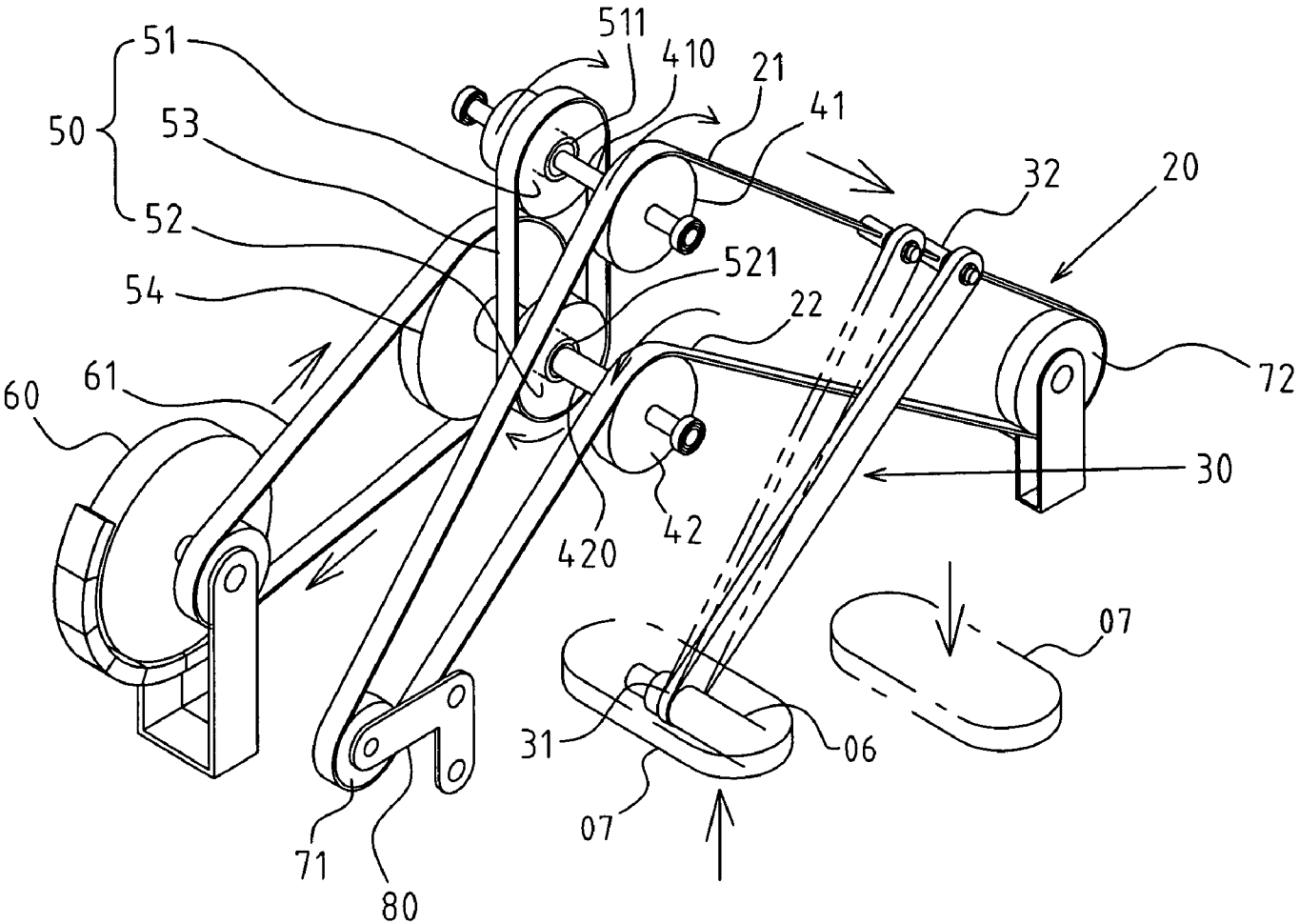
FIG. 3 shows a perspective view of a first operation of the present invention.

FIGS. 1-3 depict preferred embodiments of a bidirectional linkage single damping mechanism suitable for the leg exerciser. The embodiments are only provided for explanatory purposes with respect to the patent claims.

The damping mechanism A includes a support frame 10, defining a grounding portion 11 and a vertical frame 12. The vertical frame 12 in FIG. 1 is formed by a n-shaped frame.

A circular drive element 20 is arranged at a preset location of the support frame 10. The circular drive element 20 shifts circularly to define a first section 21 and a second section 22 in an opposite motion direction.

A brake swinging arm 30 is provided with a coupling end 31 and a swinging end 32. The coupling end 31 is connected (or integrally connected) with the treading rotation axis 06 of the leg sports equipment 05. The swinging end 32 is connected with either section of the circular drive element 20, the first section 21 or second section 22.

A first drive pulley 41 is driven by the first section 21 of the circular drive element 20. A first drive axle 410 is extended from the center of the first drive pulley 41.

A second drive pulley 42 is driven by the second section 22 of the circular drive element 20. A second drive axle 420 is extended from the center of the second drive pulley 42.

A bidirectional drive pulley assembly 50 includes a first rotary pulley 51 and a second rotary pulley 52 arranged at intervals, as well as a drive element 53 (belt or chain) for synchronous motion of the first and second rotary pulleys 51, 52. The first rotary pulley 51 is linked to the first drive axle 410 of the first drive pulley 41 via a first unidirectional bearing 511. The second rotary pulley 52 is linked to the second drive axle 420 of the second drive pulley 42 via a second unidirectional bearing 521. Moreover, the first and second unidirectional bearings 511, 521 have the same drive direction, for example, the first and second unidirectional bearings 511, 521 of the preferred embodiment drive clockwise from the first and second rotary pulleys 51, 52. Besides, a coupling wheel 54 is connected at one side of the first rotary pulley 51 or second rotary pulley 52.

A damping wheel assembly 60 is connected with the coupling wheel 54 of bidirectional drive pulley assembly 50 via belt 61 or chain, so that the damping wheel assembly 60 could be driven by the bidirectional drive pulley assembly 50. The damping wheel assembly 60 shall be composed of a gravitational wheel body, or a magnetic or elastic mechanism with adjustable resistance.

The circular drive element 20 is composed of a belt or chain, and arranged into an inverted V shape, so that the first and second sections 21, 22 are curved for the first and second drive pulleys 41, 42. Two downward revolving parts of the circular drive element 20 are positioned separately by the first limit wheel 71 and second limit wheel 72. Moreover, the first limit wheel 71 or second limit wheel 72 is assembled onto a flexible swinging seat 80 and supported flexibly.

Based upon above-specified structures, the present invention is operated as follows:

Referring to FIG. 1, the coupling end 31 of the brake swinging arm 30 is connected with the treading rotation axis 06 of the leg exerciser 05. When the user stands on the treading portion 07 of the leg exerciser 05, the treading rotation axis 06 is allowed to generate clockwise or counterclockwise rotation. The damping mechanism A could be driven synchronously to generate a damping effect.

Referring to FIG. 3, when the treading rotation axis 06 of the leg exerciser 05 rotates clockwise and drives the swinging end 32 of the brake swinging arm 30 of damping mechanism A to swing downwards, the circular drive element 20 will move clockwise. So, the first section 21 will drive the first drive pulley 41 and first drive axle 410 to rotate clockwise, then the first unidirectional bearing 511 drives the first rotary pulley 51 of the bidirectional drive pulley assembly 50 clockwise. Meanwhile, the second rotary pulley 52 is driven synchronously by the drive element 53, thus driving the coupling wheel 54 and damping wheel assembly 60 to achieve the expected resistance through the damping wheel assembly 60. As the second section 22 of the circular drive element 20 moves counterclockwise, the second drive pulley 42 and second drive axle 420 will be driven for counterclockwise rotation. As the second unidirectional bearing 521 is driven clockwise, the second rotary pulley 52 will not be driven so as to prevent any conflict due to inconsistent rotation of the first rotary pulley 51 and second rotary pulley 52.

Figure 4:
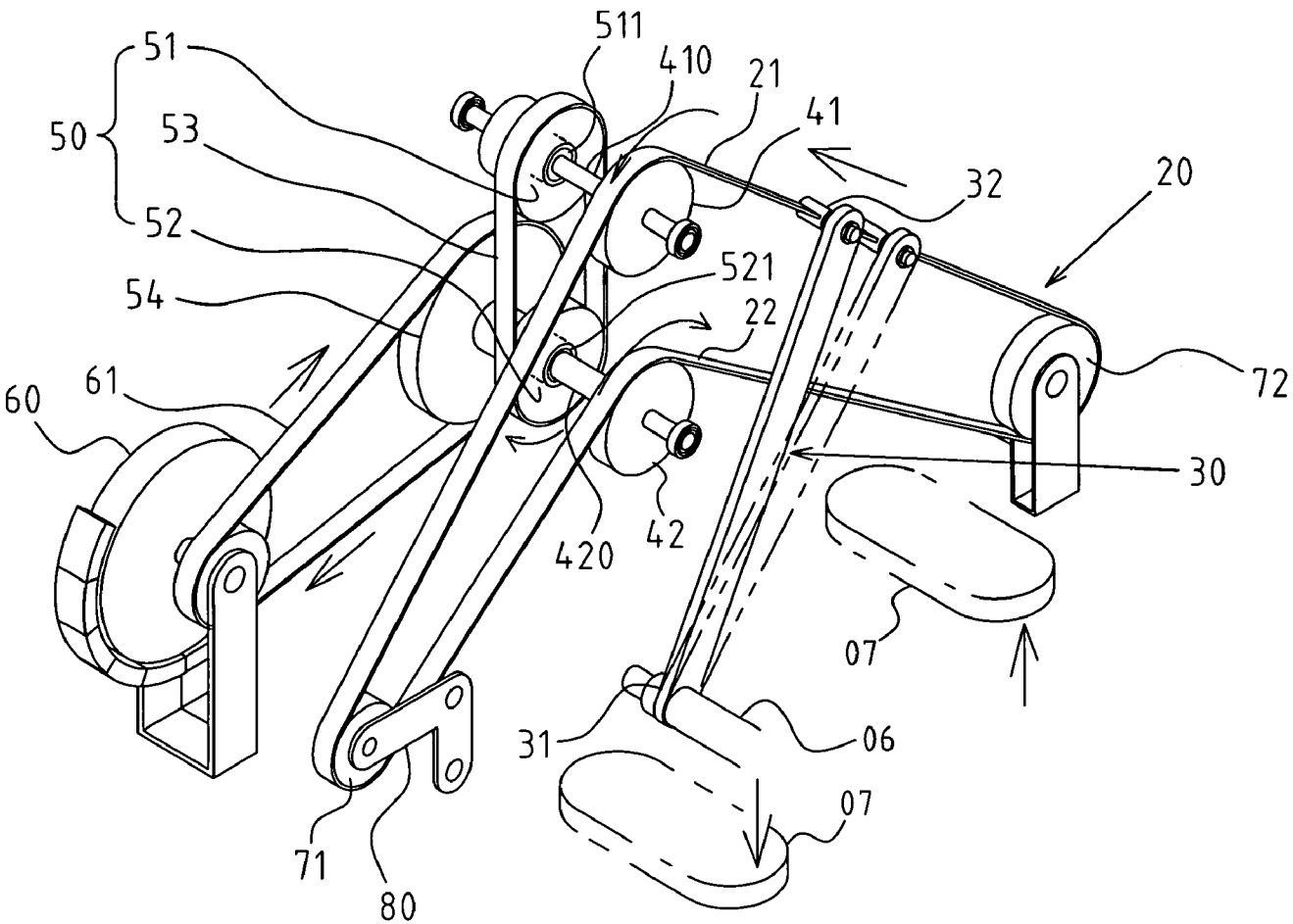
FIG. 4 shows a perspective view of a second operation of the present invention.

Referring to FIG. 4, when the treading rotation axis 06 of the leg exerciser 05 rotates counterclockwise to drive the swinging end 32 of the brake swinging arm 30 of damping mechanism A to swing upwards, the circular drive element 20 will move counterclockwise. So, the second section 22 will drive the second drive pulley 42 and second drive axle 420 to rotate clockwise, then the second unidirectional bearing 521 will drive clockwise the second rotary pulley 52 of the bidirectional drive pulley assembly 50, thus driving the coupling wheel 54 and damping wheel assembly 60 to achieve the expected resistance through the damping wheel assembly 60. As the first section 21 of the circular drive element 20 moves counterclockwise, the second drive pulley 42 and second drive axle 420 will be driven for counterclockwise rotation. As the first unidirectional bearing 511 is driven clockwise, the first rotary pulley 51 will not be driven so as to prevent any conflict due to inconsistent rotation of the first rotary pulley 51 and second rotary pulley 52.

Figure 5:
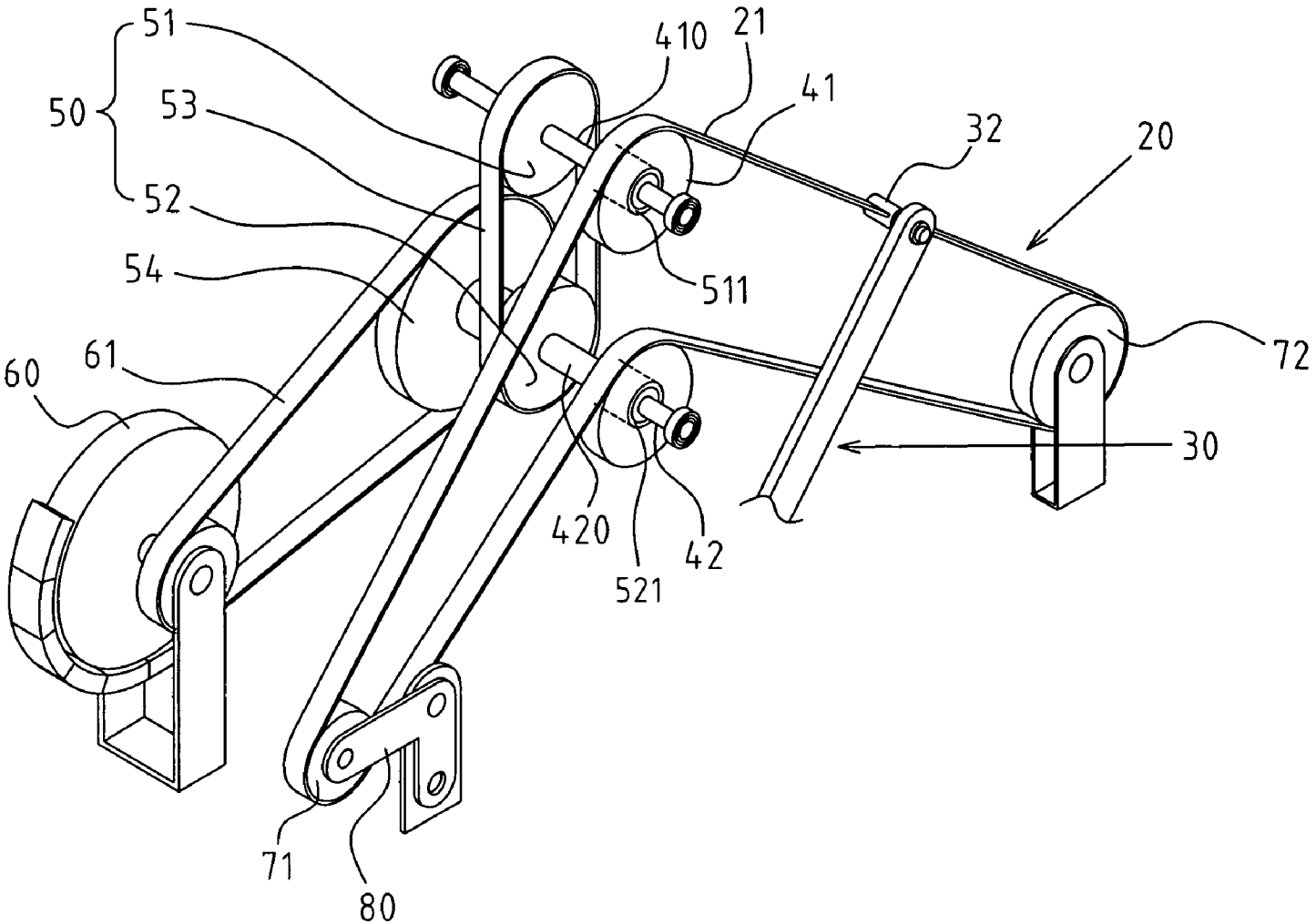
FIG. 5 shows a perspective view of another application view of changed configuration location of the first and second unidirectional bearings as disclosed in FIG. 1.

Referring to FIG. 5, the first unidirectional bearing 511 and second unidirectional bearing 521 can also be assembled laterally onto the first drive pulley 41 and second drive pulley 42.

Figure 6:
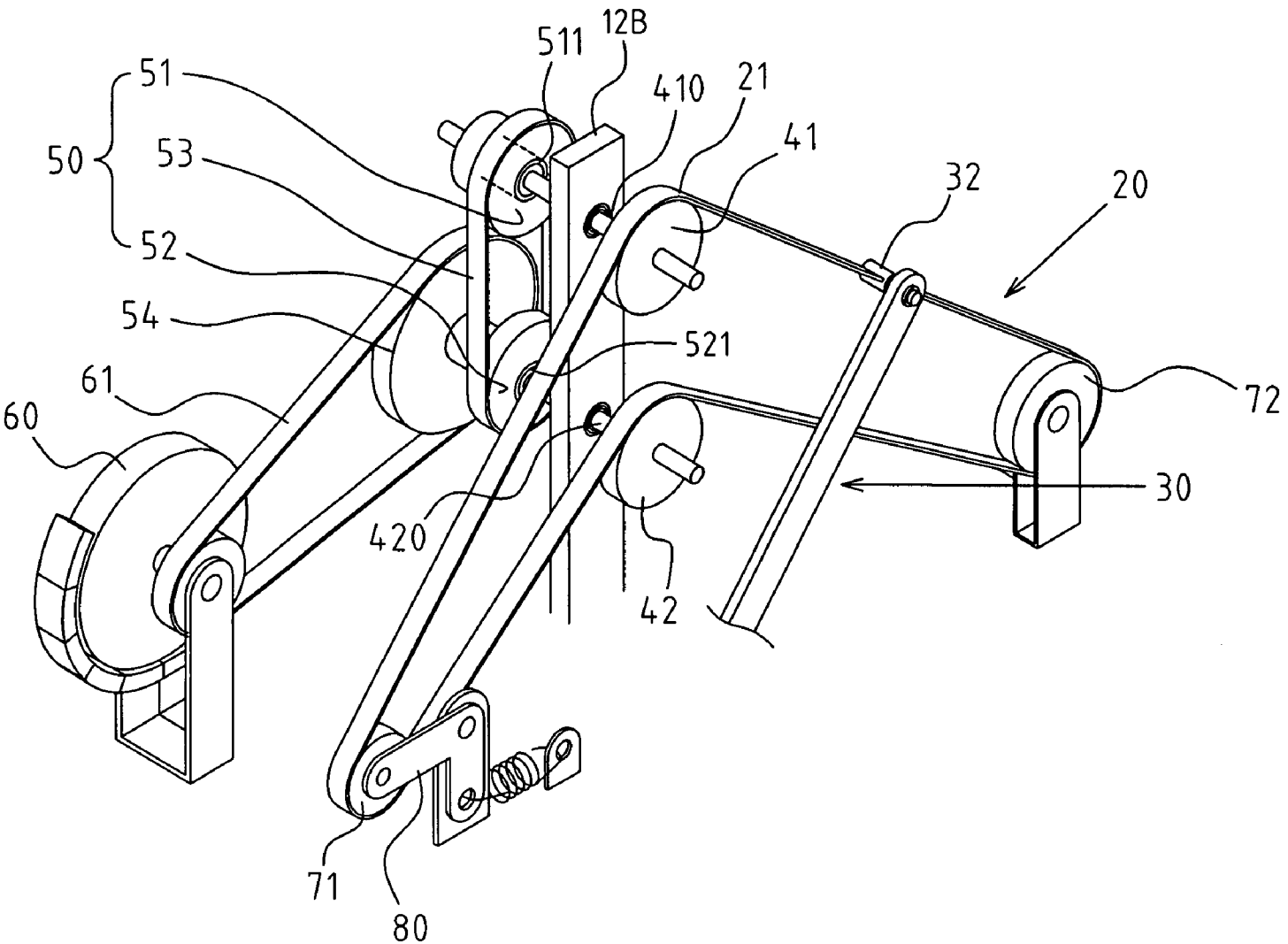
FIG. 6 shows another perspective view of the application of the vertical frame of the present invention.
Figure 7:
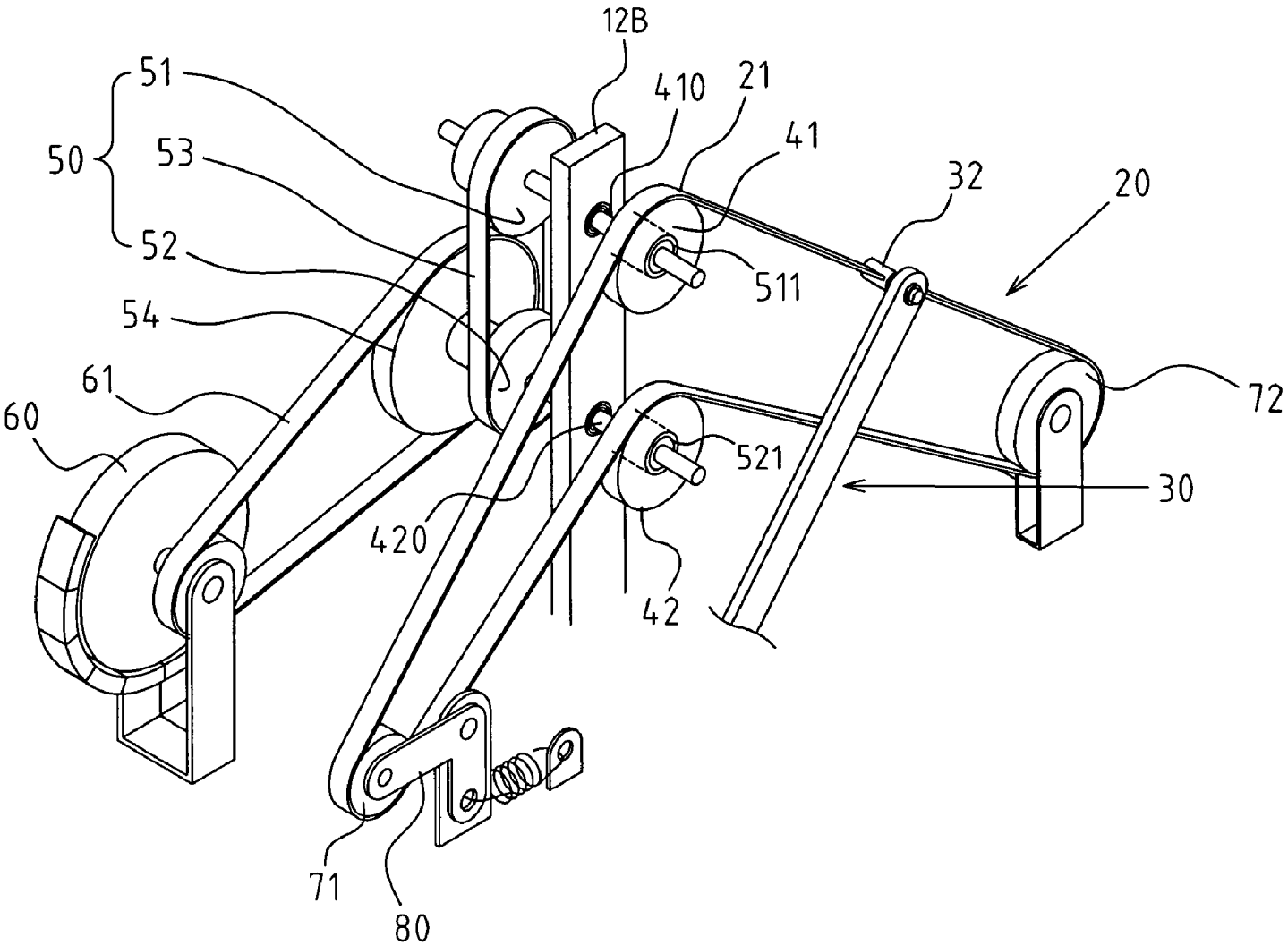
FIG. 7 shows a perspective view of the application of a changed configuration location of first and second unidirectional bearings as disclosed in FIG. 6.

Referring to FIG. 6, the vertical frame 12 is also of a vertical plate structure. Referring to FIG. 7, the first unidirectional bearing 511 and second unidirectional bearing 521 in FIG. 6 are partially changed and assembled onto the first drive pulley 41 and second drive pulley 42.

Referring to FIG. 1, the damping mechanism A and leg exerciser 05 can be combined into an integral structure.

Figure 8:
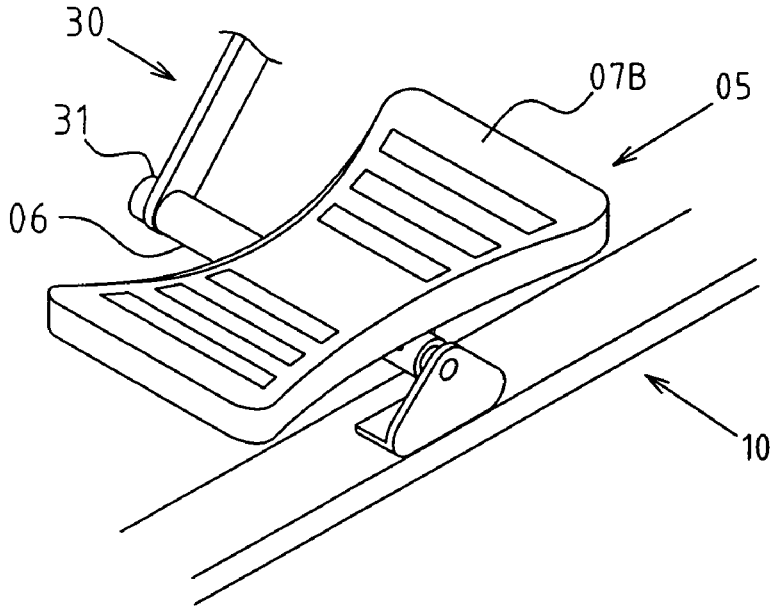
FIG. 8 shows an enlarged and isolated perspective view of other application of a treading portion of the leg exerciser of the present invention.
Figure 9:
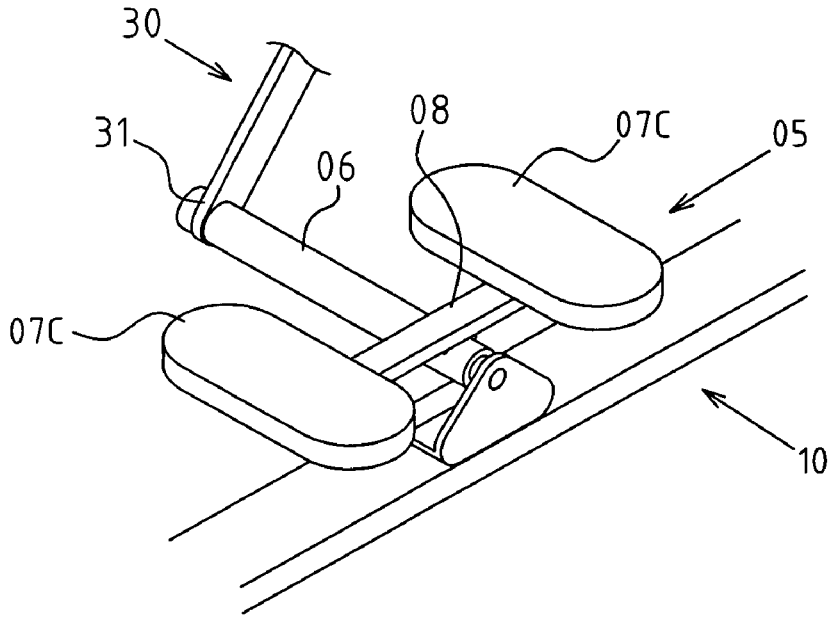
FIG. 9 shows another enlarged and isolated perspective view of a treading portion of the leg exerciser of the present invention.

The leg exerciser 05 is available with several patterns of treading portions 07, e.g. left and right stand-alone pedals as shown in FIG. 5, or a single pedal as shown in FIG. 8. Referring also to FIG. 9, a cross bar 08 is welded onto the treading rotation axis 06 of the leg exerciser 05, and then treading portion 07C is assembled at both ends of the cross bar 08.

Figure 10:
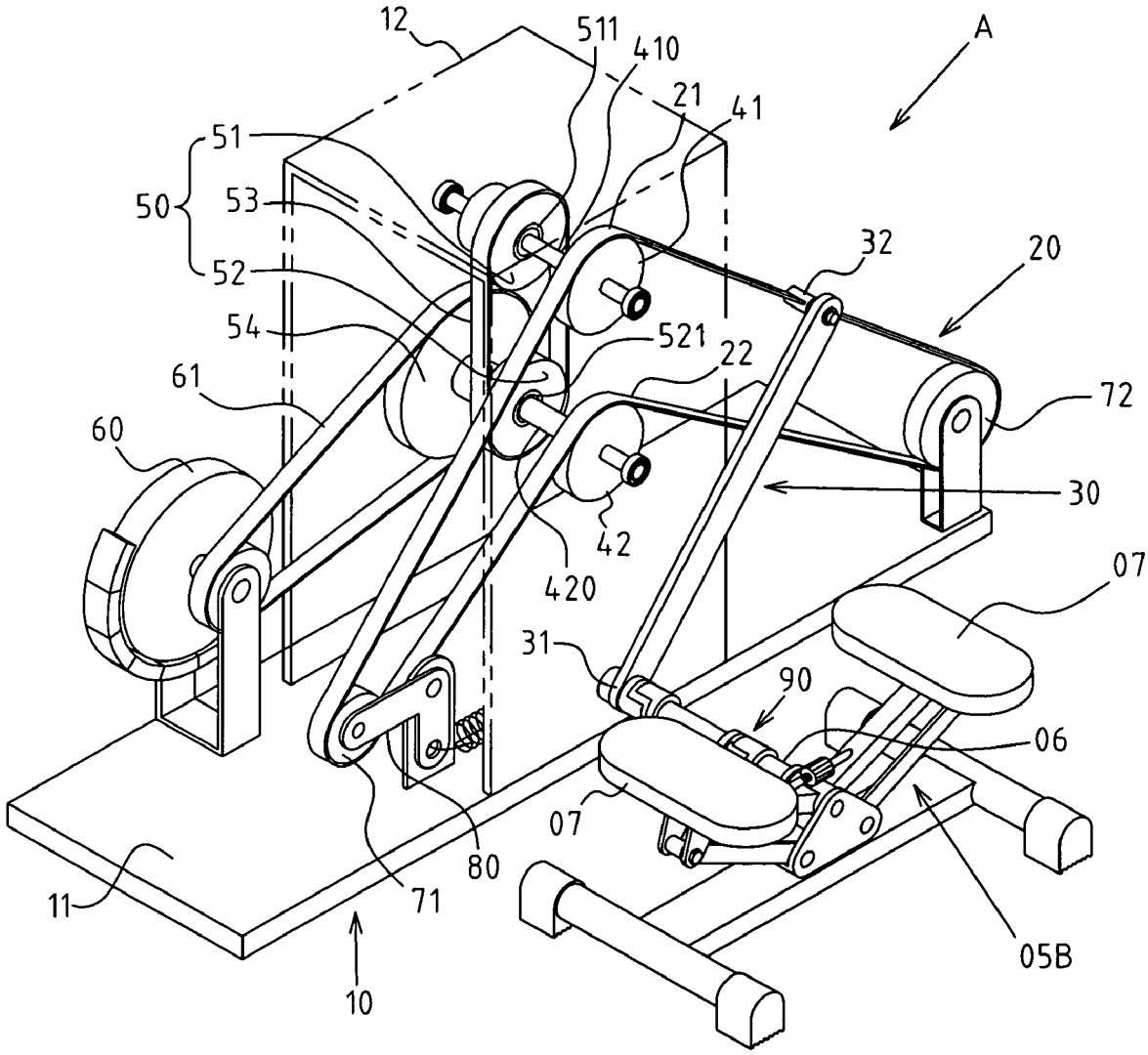
FIG. 10 shows an application view of the present invention that the sports equipment and damping mechanism are combined.

Referring to FIG. 10, the coupling end 31 of brake swinging arm 30 can be connected with the treading rotation axis 06 of the leg sports equipment 05 B via a coupler 90. The coupler 90 is a bidirectional connection bar with universal joints for easy linkage.

I claim:

1. A leg exercise device having a bidirectional linkage single damping mechanism comprising: at least one pivoting foot support which pivots about a treading rotation axis;

a support frame, defining a grounding portion and a vertical frame;

a closed loop drive element, arranged at a preset location of said support frame and having a first section and a second section which are movable in opposite directions;

a brake swinging arm, provided with a coupling end and a swinging end, said coupling end being connected to a treading rotation axis, said swinging end being connected to either said first section or said second section of said close loop drive element;

a first drive pulley, being driven by said first section of said circular drive element, and having a first drive axle extended from a center of said first drive pulley;

a second drive pulley, being driven by said second section of said closed loop drive element, and having a second drive axle extended from a center of said second drive pulley;

a bidirectional drive pulley assembly, comprising: a first rotary pulley, a second rotary pulley arranged at intervals, and a drive element for synchronous motion of the first and second rotary pulleys, said first rotary pulley being linked to said first drive axle of said first drive pulley via a first unidirectional bearing, said second rotary pulley being linked to said second drive axle of said second drive pulley via a second unidirectional bearing the first or second rotary pulley having a coupling wheel at one side thereof; and a damping wheel assembly, connected with said coupling wheel of bidirectional drive pulley assembly via belt or chain, said damping wheel assembly being driven by said bidirectional drive pulley assembly.

2. The mechanism defined in claim 1, wherein said circular drive element is comprised of a belt or chain, and arranged into an inverted V shape, the first and second sections being curved for the first and second drive pulleys, said closed loop drive element having two downward revolving parts positioned separately by the first and second limit wheels, the first or second limit wheel being assembled onto a flexible swinging seat and supported flexibly.

3. The mechanism defined in claim 1, wherein said coupling end of said brake swinging arm is connected with said treading rotation axis.

4. The mechanism defined in claim 1, wherein said coupling end of said brake swinging arm connects to the treading rotation axis via a coupler.

5. The mechanism defined in claim 1, wherein said bidirectional drive pulley assembly enables synchronous rotation of the first and second rotary pulleys via a drive element.

6. The mechanism defined in claim 1, wherein said damping wheel assembly and said coupling wheel of the bidirectional drive pulley assembly is connected and—driven by a belt or chain.

* * * * *